US005899010A

United States Patent [19]

Peck

[11] Patent Number: 5,899,010

[45] Date of Patent: May 4, 1999

[54] STATIC CLING BANNER

[76] Inventor: William C. Peck, 5832 Clearview Dr., Parma Heights, Ohio 44130

[21] Appl. No.: 08/704,384

[22] Filed: Aug. 21, 1996

[51] Int. Cl.[6] ..... G09F 7/02

[52] U.S. Cl. ..... 40/618; 40/594; 40/595; 40/617

[58] Field of Search ..... 40/618, 594, 595, 40/611, 617

[56] References Cited

U.S. PATENT DOCUMENTS

| | | | |
|---|---|---|---|
| 2,586,039 | 2/1952 | Heggedal | 40/618 |
| 3,440,746 | 4/1969 | Richards | 40/125 |
| 4,652,239 | 3/1987 | Brimberg | 434/80 |
| 4,654,101 | 3/1987 | Kane | 156/250 |
| 5,102,171 | 4/1992 | Saetre | 283/117 |
| 5,252,071 | 10/1993 | Hansard | 434/75 |
| 5,398,437 | 3/1995 | Bump, Jr. et al. | 40/604 X |
| 5,658,621 | 8/1997 | Sohn | 428/24 |

FOREIGN PATENT DOCUMENTS

| | | | |
|---|---|---|---|
| 280324 | 8/1963 | Austria . | |
| 2089091 | 6/1982 | United Kingdom | 40/611 |

*Primary Examiner*—Cassandra H. Davis
*Attorney, Agent, or Firm*—Donald A. Bergquist

[57] ABSTRACT

A reusable sign/banner system which includes flexible static cling vinyl indicia and a sheet of flexible, smooth, non-porous, flaccid plastic material. The indicia are electrostatically adhered to the plastic sheet. The indicia are cut in a plurality of shapes and forms as to form letters, numbers and symbols for the purpose of creating signs and banners to communicate words, numerical expressions and directions. In use, the indicia are peeled from a plasticized paper backing sheet and applied to the flexible, smooth, non-porous plastic material in a variety of configurations. The banner material can be hung by grommets installed in the sheet of flexible, smooth, non-porous plastic material or displayed against any irregular or curved surface or hung across open spaces. Both the static cling vinyl and the flexible, smooth, non-porous plastic material can be provided in a variety of colors to facilitate visibility.

2 Claims, 3 Drawing Sheets

STATIC CLING BANNER

BACKGROUND OF THE INVENTION

1. Field of the Invention

It has long been recognized that there is a need for temporary signs and banners that can easily be changed as the information contained on the sign changes. In addition, there is always a need for clear, well-constructed sign systems which can be managed by individuals with limited artistic skills. Further, there is a need for reusable sign/banner systems that are flexible to accommodate many display and storage constraints.

2. Description of the Prior Art

In this regard, U.S. Pat. No. 4,654,101 describes a method for affixing letters, numbers and the like onto a sign using magnetic attachment and letters that are tapered in order to make the sign look more like a continuous sign. Likewise, U.S. Pat. No. 3,440,746 describes a method for using a pressure sensitive adhesive to attach onto a backing material a clear film onto which individual letters or numbers have been printed, thereby to make custom-designed signs. In most instances, the ability of pressure sensitive adhesives to be reused over and over again is severely limited by the tendency of the adhesive to become irreversibly contaminated with dirt and debris. It is also known that various static cling materials can be used to affix images to surfaces, usually surfaces that are flat and rigid, such as glass or plastic. In this regard, U.S. Pat. No. 5,102,171 reveals a greeting card containing an image printed on a clear static cling material that can be removed from the card and placed upon a window or mirror and held in place by the static cling nature of the material. Likewise, U.S. Pat. No. 4,652,239 reveals the use of static cling images for space arranging and planning systems. U.S. Pat. No. 5,252,071 teaches the use of static cling drapery images to simulate the appearance of drapes on windows for easy visualization by designers and their potential clients. In addition, it is possible to purchase letters and numbers that have been printed onto clear static cling sheet for use on glass windows, etc.

SUMMARY OF THE INVENTION

I have surprisingly discovered that letters, numbers, and other images may be cut out of static cling sheet and affixed onto a non-rigid, flexible plastic sheet backing of contrasting color using only the static cling adhesion such that the indicia cling with sufficient tenacity that the resulting product can serve effectively as a temporary sign or banner that is, in use, disposed in a substantially vertical plane, wherein the sheet backing is flexible to the point of being substantially limp or flaccid. I find this surprising because most static-cling products describe affixing them to smooth, non-conductive surfaces that have a relatively high degree of rigidity such that they are self-supporting—a window pane, a tiled surface, a painted surface, a coilable or curlable plastic surface, an enameled surface, or the like—not anything so limp or flaccid as the materials I employ. The banner may be used indoors or outdoors as the flexing of the backing material of the banner does not appear to affect the adhesion of the indicia to the backing; nor does rain appear to loosen the indicia.

After the sign or banner of my invention has been used for its intended temporary purpose, the indicia—letters, numbers, and images—may easily be removed and the said indicia and the flexible backing may be rolled, loosely folded, or otherwise reduced in size to easily be stored in a small space for future use. The indicia may be reused an unlimited number of times by simply washing and drying them when they get dirty. The sign or banner thus created is truly reusable and alterable into any number of different signs and banners. Such a sign or banner is clearly cost effective and easy to use and reuse for a wide variety of intended purposes.

BRIEF DESCRIPTION OF THE DRAWINGS

This invention will be most easily understood by referring to the figures attached hereto, wherein.

DETAILED DESCRIPTION OF THE PREFERRED EMBODIMENTS

The various figures attached hereto are useful in describing this invention. In these figures, the same part is identified throughout by the use of a unique reference number.

Firstly, it must be understood that the term "static cling" used throughout this disclosure refers to the common effect known as static cling. No implication is here made as to whether the force that causes static cling is only an attractive force due to static electricity. Other forces, in fact, may contribute to the overall adhesion of one material to another that is generally referred to as static cling. A "static cling material" is a material particularly known to produce a static cling effect.

Figure 1:
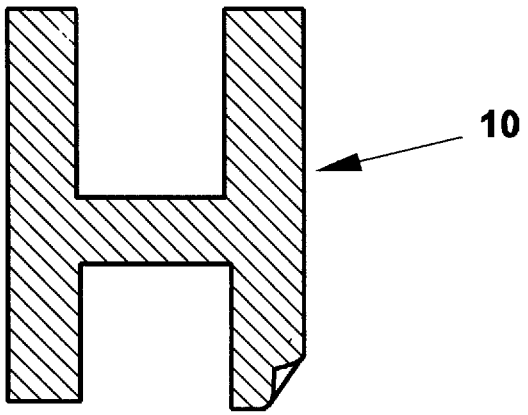
FIG. 1 illustrates an example of an element of indicia are a part of the present invention.

This invention comprises letters, numbers, or other images, collectively known as indicia, that are cut out of a static cling material and then may be placed upon a flaccid flexible plastic backing sheet of contrasting color, to which backing the indicia will adhere by static cling, thereby to quickly and easily make a temporary sign or banner that can be modified and reused repeatedly. All materials can be easily stored because of the flexibility of the indicia and particularly the flexibility of the backing sheet. The indicia, an example of which is shown as 10 in FIG. 1, may be cut from any of the static cling materials already known in the art, but static cling vinyl is greatly preferred because of its low cost and efficacy. Static cling vinyl is well known and consists primarily of highly plasticized polyvinyl chloride.

The indicia may be of any color that contrasts with the color of the backing sheet. A wide variety of colors can thus be used, but black is the preferred color for letters and numbers.

The thickness of the static cling sheet stock from which the indicia are cut may vary between widely-separated extremes. The physical properties of the type of material from which the static cling sheet stock is made affects the selection of the thickness to be used. Thus, when using a material that has an inherent stiffness, one would select sheet stock of a reduced thickness. In general, sheet stock having a thickness ranging from 0.0005 to 0.025 inches is used. More preferred is sheet stock in the thickness range of from 0.001 to 0.015 inches. The most preferred thickness is 0.003 to 0.010 inches, regardless of the material from which the sheet is made.

The indicia may be formed in a variety of ways. The preferred methods are to cut them out of the static cling material using either die cutters or computer-aided cutting tools, both of which cutting processes are familiar to those skilled in the art. A die cutter can be made by forming sharp-edged protrusions on a metal surface wherever a cut is desired and then bringing the sharp-edged protrusions into contact with the static cling sheet, either by rolling the sheet between the die and a backing roller or by making the die out of flat metal and then pressing or hammering it into contact with static cling sheet material. Alternatively, a computer-aided cutter, such as an Ioline 3479 plotter, may be used to cut the letters from the static cling sheet.

Static cling vinyl is commercially available from Design Impressions, Inc. (Design Impressions, Inc., 1480 Enterprise Parkway, Twinsburg, Ohio 44087-2242, a wholesale distributor of silk screening materials) and often comes with a release paper or cardboard backing. A preferred embodiment of this invention includes cutting only the vinyl and not the backing paper or cardboard by controlling the die pressure or the penetration or cutting depth if the computer aided cutter is used. While any individual pieces of the indicia are not in use, they may conveniently be stored on the release paper or cardboard backing to which they readily adhere, thereby facilitating handling the unused indicia.

Obviously, the computer-aided cutter is best chosen for creating indicia involving custom designs, whereas the die cutter is best chosen for mass production of commonly-used indicia such as letters or numbers of common type fonts. The size of the indicia will depend on the intended use for the sign or banner, as well as artistic sense of the user assembling the sign or banner. I have found that large indicia are preferred for ease of handling and applying. Small indicia are more susceptible to tearing during handling and are more difficult to place accurately on the backing sheet. It is generally desirable to have letters greater than one-half inch in height. Letters over one inch tall are more preferred. Letters over two inches tall are even more preferred. Letters over five inches tall are most preferred.

Figure 2:
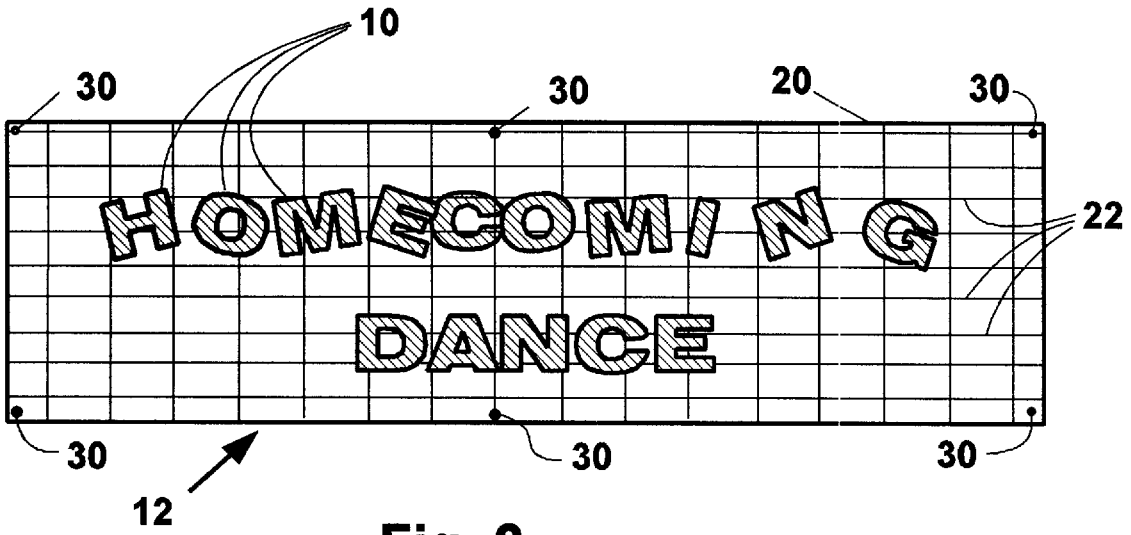
FIG. 2 illustrates a sign/banner of the present invention comprising a backing sheet and indicia such as is shown in FIG. 1 in a contrasting color.

FIG. 2, shows a banner/sign 12 of the present invention, comprising a backing sheet 20, having indicia 10 adhering thereto and a plurality of grommets 30 at least along the top edge thereof The backing sheet 20 can be made of any one of a number of flexible, smooth, substantially flaccid, non-porous, non-conductive plastic material. Typical materials might be plasticized polyvinyl chloride, polyethylene terephthalate (PET), ethylene propylene diene monomer rubber (EPDM), thermoplastic elastomers such as polyurethanes, polyolefin elastomers, natural or synthetic rubbers, and the like. Plasticized polyvinyl chloride is preferred.

The color of the backing sheet 20 is not critical as long as it provides contrast with the color of the indicia 10. Black indicia on a white backing sheet is the most preferred color combination. It is obvious that the indicia do not all have to be of the same color.

The size of the backing sheet 20 may vary widely. The size of the backing sheet depends upon several factors. The most important factor is likely the space limitations of the environs. The strength and thickness of the backing sheet material and the method of support chosen for the sign or banner seem next in importance. Finally, one must consider the size of the letters to be placed thereon and the overall impact of the overall combination of variables. Although there is no theoretical minimum size, I have found backing sheets larger in size than about three feet by two feet to be preferred. Backing sheets larger than about five feet by three feet in size are more preferred and sizes larger than about ten feet by five feet even more preferred. The most preferred size is larger than about fifteen feet by five feet. The upper size is limited by the constraints already mentioned above. The physical properties of the type of material from which the backing sheet stock is made affects the selection of the thickness to be used. Thus, when using a material that has an inherent stiffness, one would select sheet stock of a reduced thickness. Generally, sheet stock having a thickness of 0.0005 to 0.025 inches is used for the backing sheet. More preferred is sheet stock having a thickness in the range of 0.001 to 0.020 inches. The most preferred thickness is 0.005 to 0.015 inches.

Figure 3:
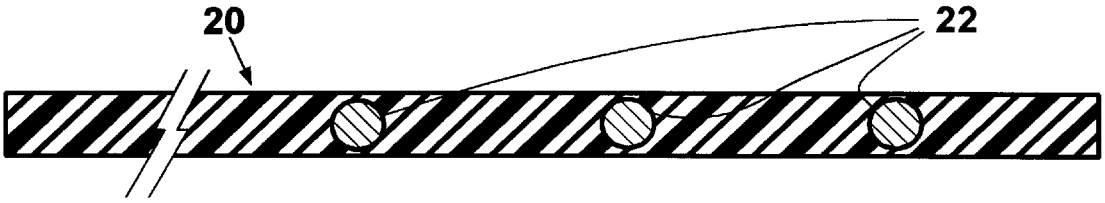
FIG. 3 shows in cross-sectional view an embodiment wherein the backing sheet includes strands that aid in placing indicia on the backing sheet.
Figure 4:
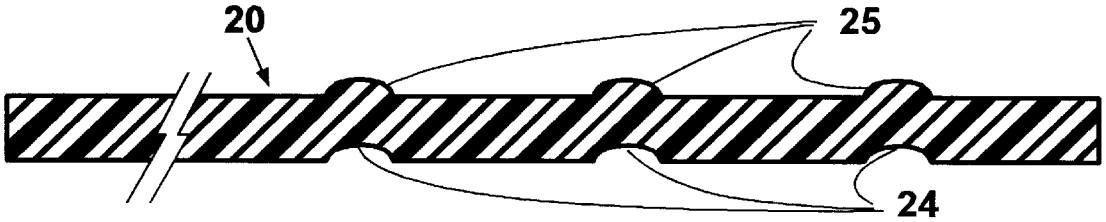
FIG. 4 shows in cross-sectional view an embodiment wherein the backing sheet is imprinted with lines that aid in placing indicia on the backing sheet.
Figure 5:
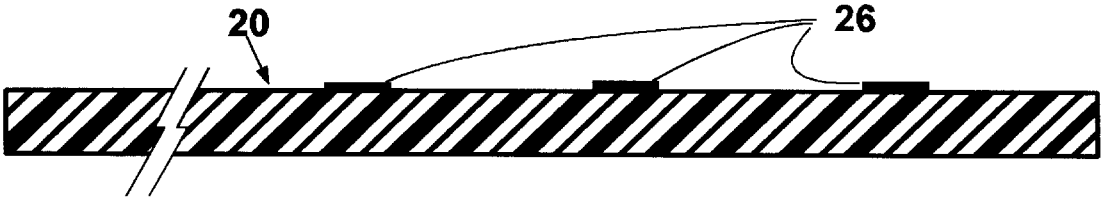
FIG. 5 shows in cross-sectional view an embodiment wherein the backing sheet is printed with lines that aid in placing indicia on the backing sheet.

As is illustrated in FIG. 3, the backing sheet 20 may also include reinforcing strands 22 within the material thereof, which strands serve the dual purposes of increasing the overall tensile strength of the backing sheet and also providing reference lines that aid in the placement of said indicia. Such strands 22 are shown in enlarged detail in FIG. 3. As an alternative to such strands, FIG. 4 illustrates in enlarged detail that the backing sheet may be imprinted with reference lines 24 25 to aid in the placement of indicia thereon. The reference lines may be imprinted into the fabric of the backing sheet, either as linear indentations, as shown at 24, or as raised lines, as shown at 25, during a calendering operation of the web from which the backing sheet is cut. FIG. 5 shows in enlarged detail that the reference lines 26 may be printed onto the fabric of the backing sheet as fine lines or faint lines.

The backing sheet 20 must also be equipped with a means of fastening it in place such as hanging it on a wall or suspending it from the ceiling. I have found that metal grommets 30 inserted at the top edge and corners are very satisfactory for this purpose; those skilled in the art will realize that this is just one of many possible means for displaying the sign or banner in a substantially vertical plane.

One preferred method for forming the sign or banner out of the backing sheet and the indicia involves first positioning the indicia 10 gently onto the backing sheet 20 while it lies flat on a horizontal surface such as a table or floor. The indicia 10 can be moved about until the sign or banner appears correct. The indicia 10 are then adhered in position by pressing and smoothing them into static-cling contact with the backing sheet 20. Then the sign or banner 12 may be placed on a wall or otherwise suspended in its final position.

Figure 6:
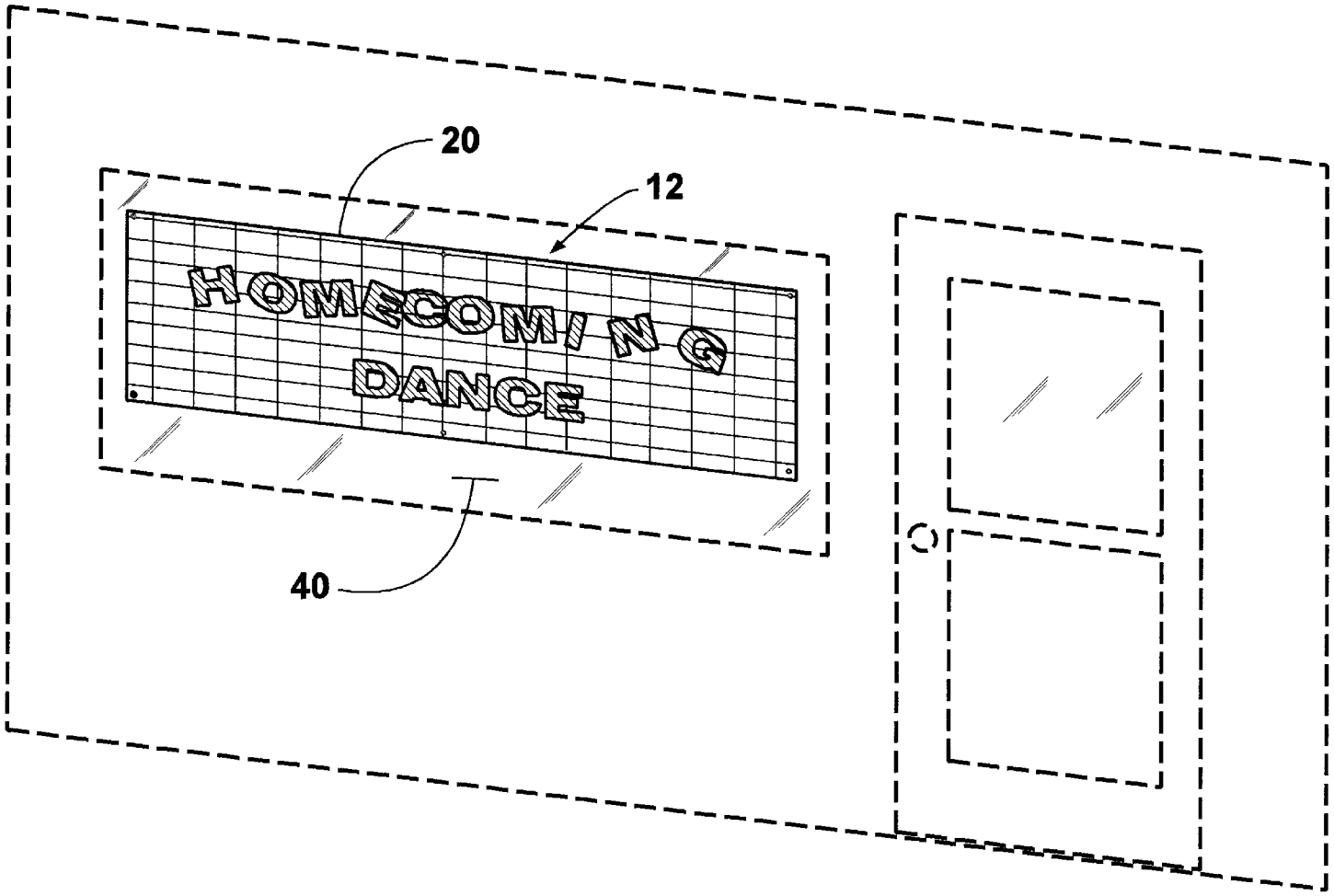
FIG. 6 illustrates the application of an embodiment of the present invention wherein the backing sheet is of static-cling material to cling to a wall.

As shown in FIG. 6, an advantage also exists for the backing sheet 20 itself to be made out of static cling material in that it can in turn be held in its final display mode by using its static cling adhesion to hold the completed sign or banner onto a smooth, non porous, non-conductive surface such as glass, tiles, or enamelled surfaces 40. This feature may be of great advantage in locations where it is not possible or not advisable to satisfactorily use magnets or fasteners on or in the surfaces or in suitable nearby supports.

After the sign or banner 12 has served its temporary function, the indicia 10 can be peeled from the backing sheet

20 and returned to the release paper or cardboard backing for storage. After the indicia have been removed from the backing sheet, the backing sheet 20 can be rolled or folded for easy storage. Rolling is the preferred storage means, thereby to avoid the formation of creases in the backing sheet. Alternately, the backing sheet 20 can be stored with some or all of the indicia 10 still adhering to the backing sheet by means of static cling. This feature is a particularly attractive option if only minor modification of the sign or banner is anticipated for its next use.

Obviously, another preferred embodiment of this invention is to make the backing sheet 20 out of static cling material—particularly static cling vinyl—and the indicia 10 out of the non-porous plastics as described above. This embodiment also offers all of the advantages cited above.

Whereas the present invention has been described in terms of specific embodiments, certain modifications and equivalents will be apparent to those skilled in the art and are intended to be included within the scope of the present invention, which scope is limited only by the appended claims.

I claim:

1. A system for providing changeable signs of the type referred to as free hanging banners, said system comprising in combination:

a.) a backing sheet cut from a web of flexible, smooth, substantially flaccid, non-porous, non-conductive plastic material and having a first color;

b.) supporting means for said backing sheet to provide for suspending it in a substantially vertical plane, wherein said supporting means comprises a plurality of grommets along one edge of said backing sheet; and c.) a plurality of indicia elements, each cut out of flexible, smooth, substantially flaccid, non-porous, non-conductive plastic material and having a second color that contrasts with said first color and that adhere to said backing sheet by a force known as static cling with sufficient tenacity that flexing of said backing sheet along more than one axis as might be caused by a breeze in both indoor and outdoor use while it is displayed suspended in a vertical plane does not cause said elements of indicia to be released;

wherein, in use, said backing sheet is suspended by said supporting means in said substantially vertical plane to display said indicia elements with no protective covering for said indicia elements, thereby to convey information.

2. A system for providing changeable signs of the type referred to as free hanging banners, said system comprising in combination:

a.) a backing sheet cut from a web of flexible, smooth, substantially flaccid, non-porous, non-conductive plastic material and having a first color, wherein said backing sheet includes reinforcing strands within the material thereof, which strands serve the dual purposes of increasing the overall tensile strength of the backing sheet and also providing reference lines that aid in the placement of said indicia;

b.) supporting means for said backing sheet to provide for suspending it in a substantially vertical plane; and c.) a plurality of indicia elements, each cut out of flexible, smooth, substantially flaccid, non-porous, non-conductive plastic material and having a second color that contrasts with said first color and that adhere to said backing sheet by a force known as static cling with sufficient tenacity that flexing of said backing sheet along more than one axis as might be caused by a breeze in both indoor and outdoor use while it is displayed suspended in a vertical plane does not cause said elements of indicia to be released;

wherein, in use, said backing sheet is suspended by said supporting means in said substantially vertical plane to display said indicia elements with no protective covering for said indicia elements, thereby to convey information.

* * * * *